US005195611A

United States Patent [19]

Untz

[11] Patent Number: 5,195,611

[45] Date of Patent: Mar. 23, 1993

[54] PORTABLE OBSERVATION AND HUNTING STAND

[76] Inventor: Reese E. Untz, 4902 Ridge Rd., Charlotte, N.C. 28269

[21] Appl. No.: 845,279

[22] Filed: Mar. 3, 1992

[51] Int. Cl.[5] ..... A47F 3/26

[52] U.S. Cl. ..... 182/187; 182/116; 182/129

[58] Field of Search ..... 182/129, 187, 179, 163, 182/152, 63, 116

[56] References Cited

U.S. PATENT DOCUMENTS

| | | | |
|---|---|---|---|
| 444,280 | 1/1891 | Pepin | 182/206 |
| 535,082 | 3/1895 | Snell . | |
| 1,148,035 | 4/1915 | Miller . | |
| 1,672,717 | 6/1928 | Gentner . | |
| 3,057,431 | 10/1962 | George . | |
| 3,282,375 | 1/1966 | Ray | 182/214 X |
| 3,336,999 | 8/1967 | McSwain . | |
| 3,630,314 | 12/1971 | Bamburg . | |
| 4,428,456 | 1/1984 | Rohde | 182/129 X |
| 4,552,247 | 11/1985 | Purdy . | |
| 4,742,888 | 5/1988 | Amacker . | |
| 4,905,792 | 3/1990 | Wilson . | |
| 5,009,283 | 4/1991 | Prejean | 182/187 X |
| 5,016,732 | 5/1991 | Dunn . | |
| 5,064,020 | 11/1991 | Eagleson . | |
| 5,086,872 | 2/1992 | Lin | 182/129 X |

*Primary Examiner*—Alvin C. Chin-Shue

*Attorney, Agent, or Firm*—Shefte, Pinckney & Sawyer

[57] ABSTRACT

A mobile observation and hunting stand apparatus having a ladder-like frame, a seat affixed to one end, a base at the other end, and a wheel permanently mounted to the frame adjacent the base. A brace assembly which may be detachably mounted to the frame is provided so that the stand apparatus may be leaned against a tree or used with the brace assembly mounted thereto as a free standing unit. The frame is formed of two portions, hinged in the center, and may be folded in half for transport and storage thereof.

3 Claims, 4 Drawing Sheets

PORTABLE OBSERVATION AND HUNTING STAND

BACKGROUND OF THE INVENTION

The present invention relates generally to tree stands for hunting and more particularly to portable ladder-type tree stands.

Deer hunters and other sportsmen often utilize tree stands as elevated hunting platforms when hunting large game such as deer or elk. Basically, tree stands are of two general types. Climbing tree stands have a seat or other platform mounted to a framework adapted to encircle a tree, pole, or the like by which the user can manipulate the structure upwardly and downwardly along the tree trunk or pole to assist the user in climbing to and from the desired elevation. Ladder-style tree stands, on the other hand, have a seat or other platform mounted to one end of a ladder-like structure which can be placed against a tree or pole to support the overall structure while the user climbs to a from the seat or platform along the ladder portion.

In either case, hunting from a stand provides the sportsman with numerous advantages, such as the ability to observe an unobstructed view of a large area, increasing the hunter's chance for success. In addition, the chance of a hunter being sighted or scented by an animal is greatly reduced. Further, and perhaps more important, the hunter is removed from the line of fire of other ground-based hunters and by firing at a downward angle, any bullets which miss or pass through their target are directed into the ground. Accordingly, a hunter in a tree stand is typically safer and more successful than a ground-based hunter.

Various portable ladder-type hunting stands are known in the art. Bamburg U.S. Pat. No. 3,630,314 discloses a sectioned ladder-like hunting stand that may be readily clamped to a tree and disassembled into sections for transporting on the back of a hunter. Purdy U.S. Pat. No. 4,552,247 discloses another ladder-like hunting stand which leans against a tree, is chained thereto and, again, has the ability to be disassembled into sections for hunter mobility. Amacker U.S. Pat. No. 4,742,888 discloses a foldable ladder hunting stand which is chained to a tree and folds into a compact unit for transportation. Wilson U.S. Pat. No. 4,905,792 discloses a large platform affixed to a collapsible ladder for leaning against a tree and being chained thereto. Dunn U.S. Pat. No. 5,016,732 discloses a sectioned ladder and a platform which is attached to a tree, the sectioned ladder being comprised of removable ladder sections for portability with an uppermost frame portion which functions as skids on which to drag the hunting stand around. Eagleson U.S. Pat. No. 5,064,020 discloses another sectioned ladder having a platform at the uppermost portion for attachment to a tree, the device of Eagleson being convertible into a wheelbarrow using removable wheels and side panels. Other similar hunting stands are shown in George U.S. Pat. No. 3,057,341 which discloses a ladder having a platform attachable to a tree and McSwain U.S. Pat. No. 3,336,999 which discloses a sectioned ladder having a platform at one end thereof and a springloaded clamp for clamping the apparatus to a tree.

Ladder-type tree stands offer the advantage in comparison to climbing tree stands of enabling the hunter to conveniently climb to and from the seat or platform without the annoying and time-consuming necessity of manipulating the stand itself as is the case with climbing stands. On the other hand, ladder stands are characteristically larger, bulkier, and much more inconvenient to store and transport from one location to another than climbing stands.

Further, each type of prior stand suffers the disadvantages of requiring a tree, pole, or other like auxiliary support member to be operative, making the stands unusable in non-wooded areas which sometimes are prime hunting spots.

SUMMARY OF THE INVENTION

It is accordingly an object of the present invention to provide a mobile observation and hunting stand which overcomes the aforementioned problems of ladder-type stands. More particularly, the present invention provides a mobile observation and hunting stand that includes a wheel permanently affixed thereto for mobility, folds in half for convenient assembly and disassembly and provides removably attached support members wherein the stand of the present invention may be erected as a freestanding unit, not requiring a tree or other auxiliary support member.

According to the present invention, a mobile observation and hunting stand apparatus includes an elongated ladder-like frame having laterally-extending rungs spaced lengthwise therealong to enable a user to climb end-to-end along the frame, a base at one end of the frame for ground engagement when the frame is erected in upright disposition for use, and a seat at the other end of the frame. At least one wheel is permanently affixed to the frame at a location sufficiently adjacent the base for ground engagement of the wheel when the frame is in a generally horizontal disposition to facilitate manual rolling movement of the frame by a user gripping the frame from the other end thereof, but the wheel is spaced a sufficient distance from the base to be out of ground engagement upon erection of the frame in an upright disposition for use of the frame without removal of the wheel.

Preferably, the frame includes a first frame portion and a second frame portion pivotably attached end-to-end to one another for selective folding and unfolding movement of the frame between an operative disposition wherein the first and second frame portions are aligned in an end abutting relation and a storage and transport disposition wherein the first and second frame portions are disposed in a proximate side-by-side relation. The frame also includes a suitable arrangement for selectively locking the frame portions against relative movement when in the operative disposition.

It is preferred that the apparatus include a foot support projecting outwardly from the frame adjacent the seat, with at least a portion of the foot support being foldable against the frame for storage. Preferably, the foot support includes a platform and at least one truss member being affixed to and projecting outwardly from the frame. The platform is pivotably mounted to the frame adjacent the truss member for movement between an operative position in abutting engagement with the truss member to be supported thereby and an inoperative position wherein the platform is pivoted into abutting engagement with the frame. A pair of the truss members may be provided at a laterally spacing from one another at opposite sides of the frame to form side supports for retaining articles carried on the frame during rolling movement thereof.

According to another aspect of the present invention, the apparatus further includes a brace assembly selectively mountable removably to the frame for selective freestanding support of the frame without placement thereof against a tree, pole, or other fixed separate structure when the brace assembly is mounted to the frame and alternative support of the frame by placement against a tree, pole, or like fixed structure when the brace assembly is demounted from the frame. The brace assembly includes a pair of elongate braces each attachable at one respective end thereof to the frame adjacent the seat in an orientation wherein the opposite respective end of each brace is disposed for ground engagement at lateral spacings from one another and from the base to cooperatively form therewith a tripod-like support for the seat. It is further preferred that the brace assembly include a plurality of struts detachably mountable to extend laterally between the braces and the frame when the brace assembly is mounted to the frame to rigidify and stabilize the brace assembly and the frame relative to one another.

DESCRIPTION OF THE PREFERRED EMBODIMENT

Figure 1:
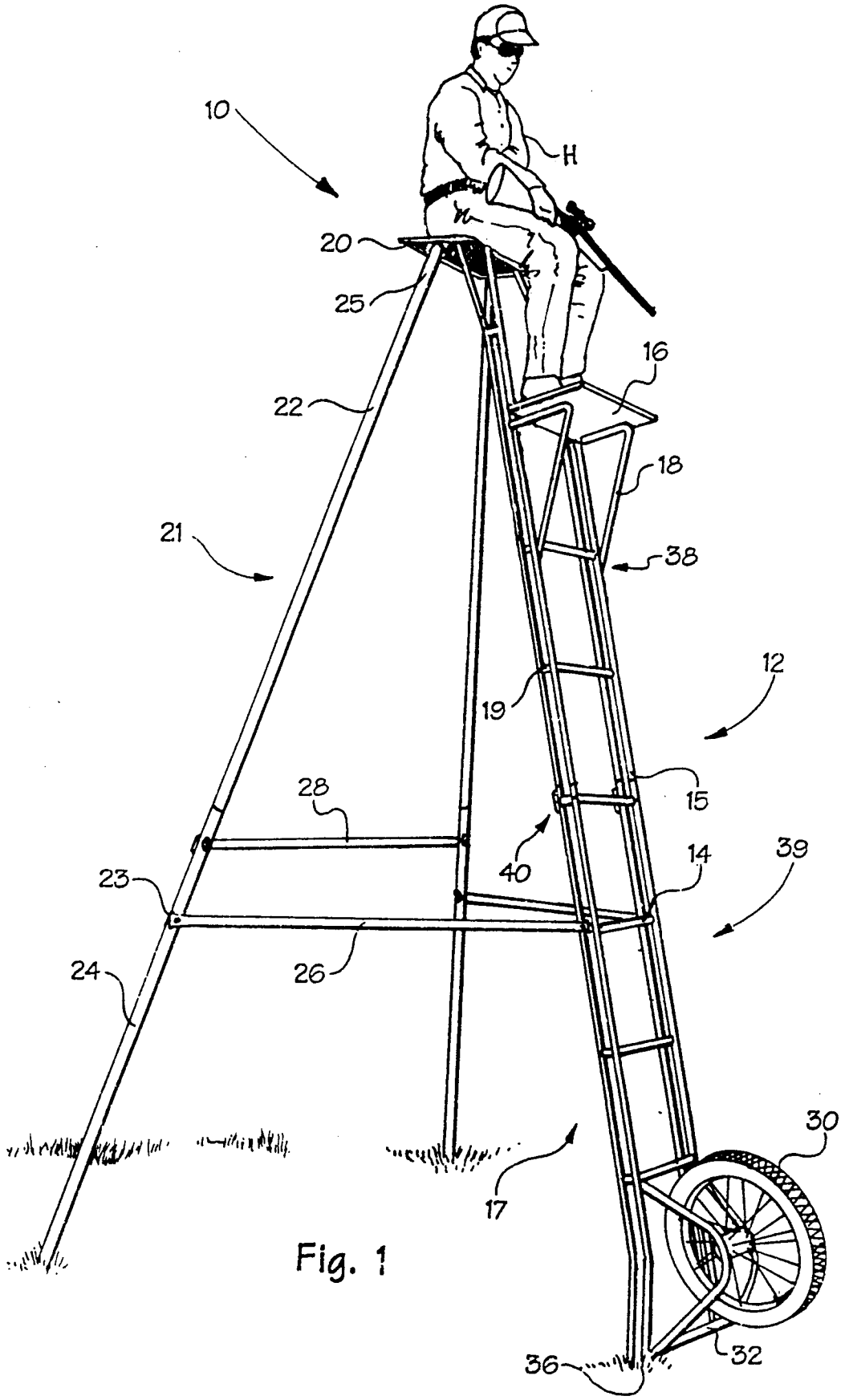
FIG. 1 is a perspective view of a mobile observation and hunting apparatus according to the preferred embodiment of the present invention.

Referring now to the accompanying drawings and initially to FIG. 1, a mobile observation and hunting stand apparatus according to the preferred embodiment of the present invention is indicated generally at 10 and basically includes a ladder-like frame 12, a seat 20 at one end of the frame 12, a base 36 and a wheel 30 at the opposite end of the frame 12, and a removable brace assembly 21.

The frame 12 is formed of a pair of elongated side rail assemblies 17 arranged lengthwise of the frame 12 in laterally spaced parallel relation, extending from the base 36 at one end of the frame 12 to the seat 20 at the other end of the frame 12, with a plurality of rungs 14 being affixed to and extending laterally between the side rail assemblies 17 at regular lengthwise spacings therealong. Each side rail assembly 17 includes two frame rail members 15 arranged in lengthwise parallel proximate side-by-side relation. Each rail member 15 of each side rail assembly 17 is affixed to its adjacent rail member 15 by a plurality of rung mounting posts 19 extending between the respective rail members 15 in perpendicular relation therewith and spaced intermittently along the length of the frame 12. The rungs 14 are mounted to the rung mounting posts 19 to extend laterally between the side rail assemblies 17 in perpendicular relation with both the rung mounting posts 19 and the side rail assemblies 17.

The seat 20 is rigidly mounted at the upper end of the frame 12 and is formed of a generally planar grid 25 affixed to the frame 12 at a slight angular orientation to the lengthwise extent Of the frame 12 such that when the frame 12 is erected for use, the seat 20 is in a vertically-spaced, generally parallel relation with the ground, providing a generally horizontal seating surface for the hunter H.

A foot support 16 is mounted to the frame 12 at a short spacing from the seat 20 for resting of the hunter's feet on the support 16 when in a sitting position on the seat 20 to provide stability for the hunter H atop the stand apparatus 10. The foot support 16 is a generally planar platform pivotably mounted to the frame 12 along one of the rungs 14 with hinges, thereby allowing the foot support 16 to pivot inwardly between its operative position in a generally perpendicular relation with the frame and a storage position in which the foot support 16 is in a parallel abutted relation with the side rail assemblies 17 of the frame 12. A pair of generally triangular truss members 18 project outwardly from each side rail assembly 17 of the frame 12 to provide a support for the foot support 16 when the frame 12 is in use and also to act as side supports for articles carried on the frame 12 when not in use, as explained in greater detail hereinafter.

Figure 2:
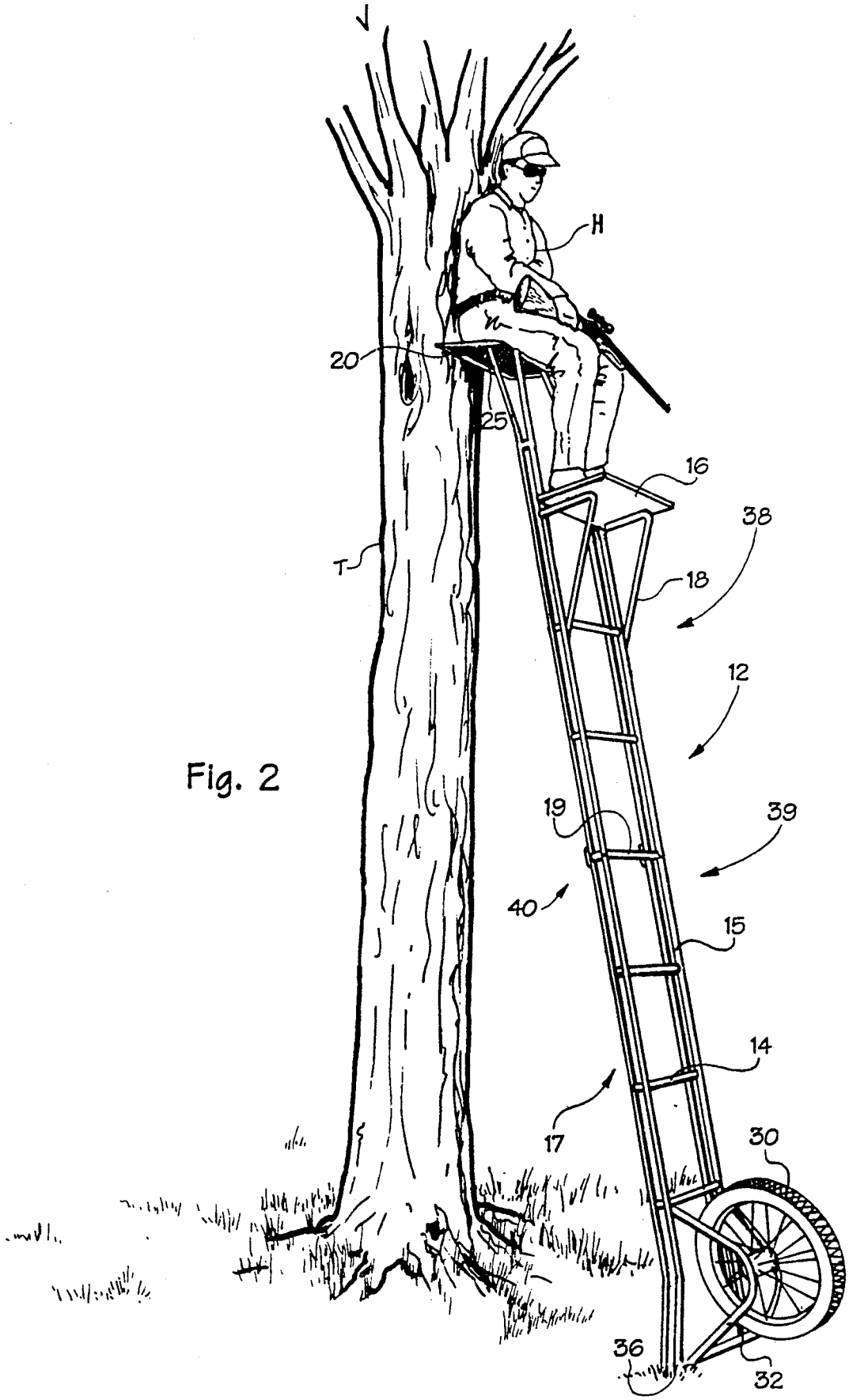
FIG. 2 is a perspective view of the mobile observation and hunting stand apparatus illustrated in FIG. 1 having the brace assembly removed and illustrating an alternative method of use for the present invention.

At the lower base end of the frame 12, a wheel 30 is mounted to the frame 12 adjacent the base 36 for manual rolling movement of the stand apparatus 10. The wheel 30 is preferably an inflatable bicycle-type tire mounted on a spoked rim, however, virtually any wheel of proper size will suffice. A pair of wheel mounting braces 32 are permanently mounted respectively to the side rail assemblies 1 of the frame 12 and extends outwardly from the frame 12 and laterally inwardly toward one another. The wheel 30 is supported on an axle assembly (not shown) mounted between the wheel mounting braces 32 at the outwardmost extent thereof. The wheel 30 is positioned a distance away from the base 36 so that the stand apparatus 10 may be erected on its base 36 without removal of the wheel 30, as shown in FIGS. 1 and 2.

Figure 4:
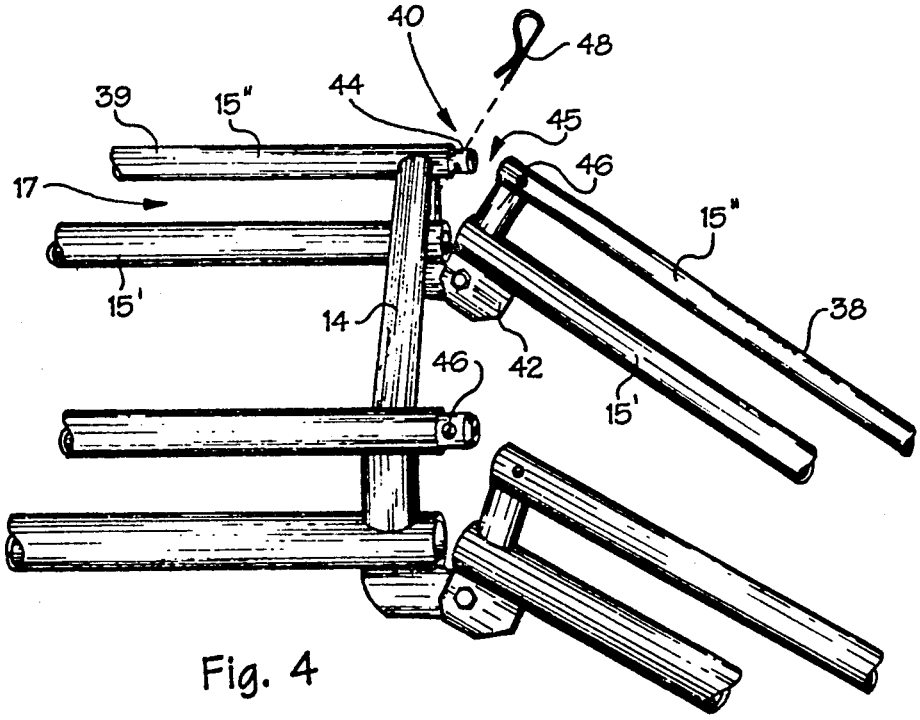
FIG. 4 is a perspective view of the swaged, hinged joint uniting the foldable sections of the frame.

According to one feature of the present invention, the frame 12 is foldable for transportation and storage of the stand apparatus 10. Each side rail assembly 17 of the frame 12 is hinged generally midway along the length of the frame 12, as indicated in FIG. 4, forming an upper frame section 38 to which the seat 20 is attached and a lower frame section 39 to which the base 36 and the wheel 30 are attached. The upper and lower frame sections 38, 39 are linked by a pivotable hinged locking mechanism 40 attached to the adjacent ends of each side rail assembly 17.

The pivotable locking mechanism 40 is best seen in FIG. 4 and includes a hinge joint 42 affixed to one rail member 15' of each side frame assembly 17 and a swaged slip joint 45 formed in the other rail member 15'' of each side frame assembly 17. The rail member 15'' associated with the lower frame section 39 has a swaged end portion 44 which is slightly smaller in outside diameter than the inside diameter of the rail member 15'' associated with the upper frame section 38, so that the swaged end portion 44 will fit securely inside of the interconnecting rail member 15''. The swaged end portion 44 may be slightly tapered toward the end to insure easy movement into and out of the end of the adjacent rail member 15". Holes 46 are formed in both the swaged end portion 44 and the interconnecting rail member 15" such that when the frame 12 is fully unfolded for use, the holes 46 are aligned for insertion of a cotter pin 48 or other retainer through the aligned holes 46 locking the frame 12 into an extended disposition. As will be explained presently, the frame 12 is foldable at the hinge joint 40 for rolling transport thereof.

The mobile observation and hunting stand apparatus 10 of the present invention has two operative modes. It can be equipped with a brace assembly 21 and erected as a freestanding unit as illustrated in FIG. 1 or it can be leaned against a tree T as seen in FIG. 2.

With reference to FIG. 1, the brace assembly 21 includes a pair of elongate rod assemblies 22 which are detachably mountable to the frame 12 adjacent the seat 20 for ground engagement at lateral spacings from one another and from the frame 12 to form, in cooperation with the frame 12, a tripod-like structure. Further, the elongate rod assemblies 22 are individually disassemblable so that the brace assembly 21 may be carried in a bundle on the frame 12 when the frame 12 is folded for rolling transport thereof.

Specifically, each rod assembly 12 is constructed of at least two brace elements 24 which may be formed of a cylindrical, hollow tubing, each brace element 24 being short enough to fit the aforementioned bundle. One respective end of each brace element 24 of each rod assembly 22 is formed with a swaged slip joint 27, shown in FIG. 5, substantially like the swaged joint 45 previously described.

The brace elements 24 are joined by inserting the swaged end portion forming the slip joint 27 into the corresponding brace element 24. Holes are formed in each brace element 24 of a mated pair 50 so as to be in alignment when the brace elements 24 are joined. A cotter pin 41 or other suitable fastener is inserted in the holes to lock the brace elements 24 into a mating relation.

To mount the brace elements 24 to the seat 20, a pair of brace mounting tubes 35 is provided. Each brace mounting tube 35 consists of a portion of cylindrical hollow tubing, such as that which forms the brace elements 24. One end of each brace element 24 is flattened, and a hole is formed in the flattened portion. A corresponding hole is formed in the outer perimeter of the seat 20, and the brace mounting tubes 35 are bolted or otherwise affixed thereto.

The brace element 24 to be mounted to the seat 34 has a swaged end portion formed therein with an outside diameter that is less than the inside diameter of the brace mounting tube 35. Accordingly, the swaged end portion of the brace element 24 may be inserted in the brace mounting tube 35. Corresponding holes are formed in both the swaged end portion of the brace element 24 and the brace mounting tube 35 for receiving a cotter pin 37 or other suitable fastener to secure the brace element 24 in mating relation with the brace mounting tube 35. A cotter pin is the fastener of choice due to its ability to provide rapid connection and disconnection of the joined brace element 24 and brace mounting tube 35.

Figure 5:
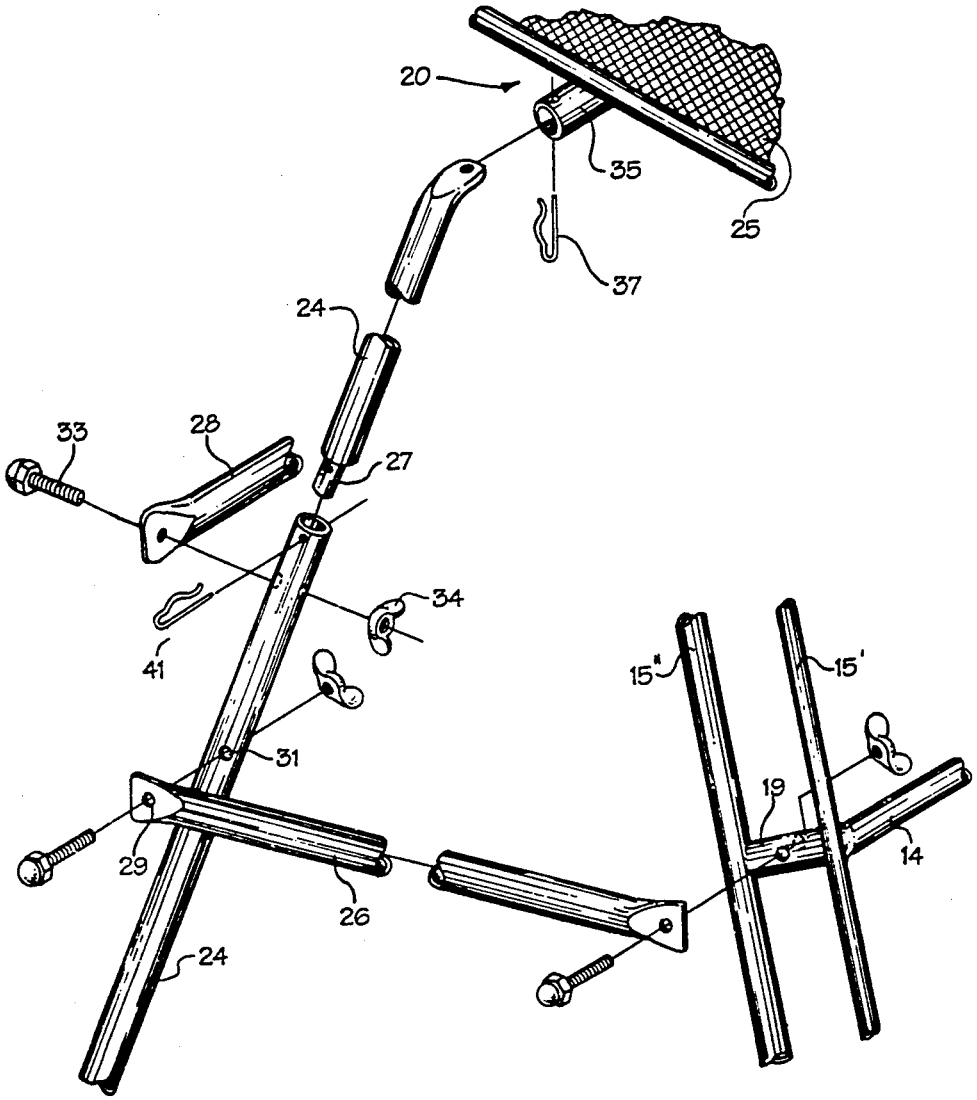
FIG. 5 is an exploded view of the assembly for joining the brace members to each other as illustrated in FIG. 1.

Three cross members, including a rear cross member 28 and two side cross members 26, are provided for lateral attachment between the brace elements 24 and the frame 12 for enhanced rigidity and stability. The rear cross member 28 is detachably mounted generally horizontally between the vertically oriented brace assemblies 22. Similarly, the side cross members 28 are detachably mounted horizontally between the vertically oriented rod assemblies 22 and the frame 12. The cross braces 26, 28 are mounted at generally near the midpoints of the frame 12 and the rod assemblies 22. As illustrated in FIG. 5, the ends of the horizontal cross members 26, 28 are flattened with a hole 29 formed in each flattened portion. Corresponding holes 31 are formed in the rod assemblies 22 and in a selected pair of the rung mounting posts 19 at opposite sides of the frame 12 to receive a conventional bolt and wing nut assembly 33, 34 through the aligned holes. For expediency in assembly and disassembly of the brace assembly 21, the bolts 33 may be permanently secured to either the cross members 26, 28 or the rod assemblies 22 and rung mounting posts 19, which aids in assuring that the nut and bolt assemblies are not lost upon disassembly.

Figure 3:
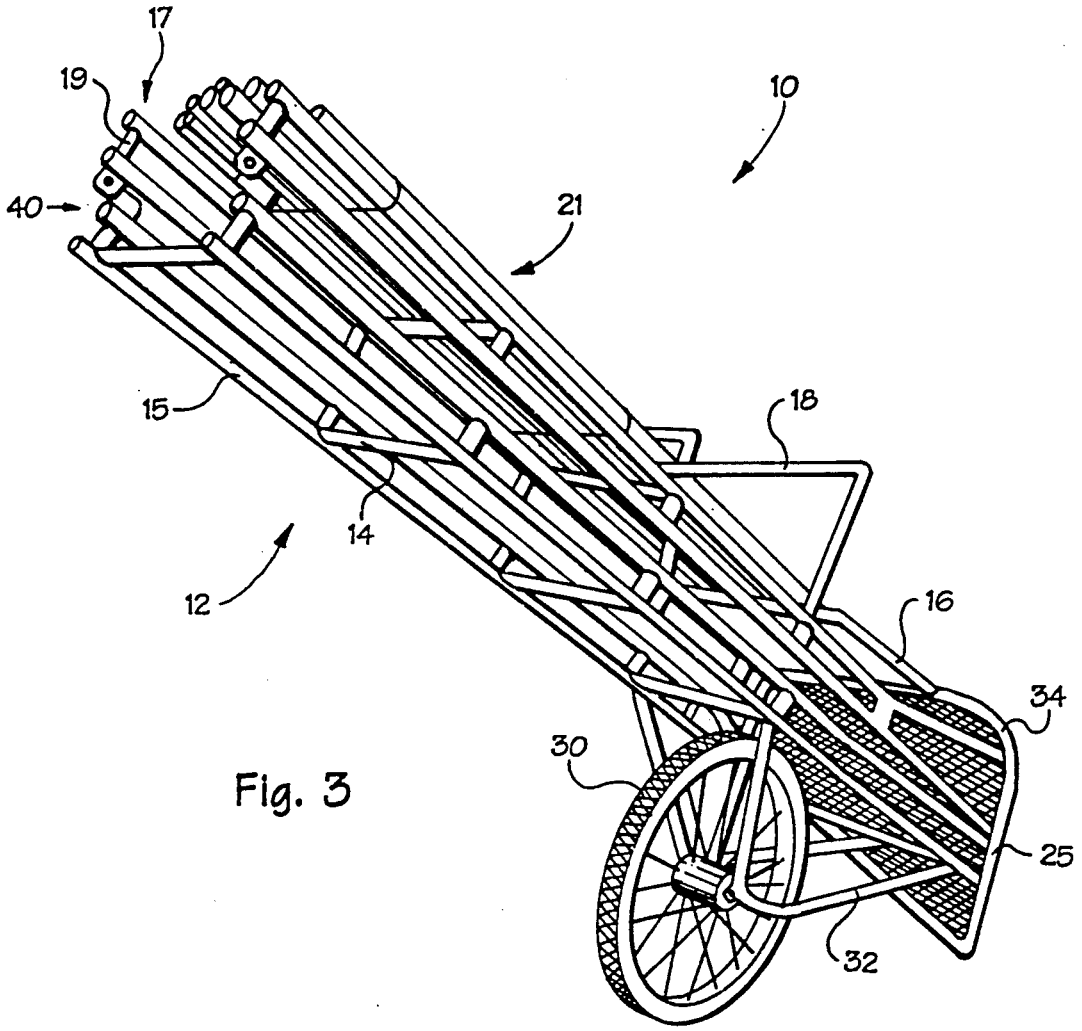
FIG. 3 is a perspective view of the mobile observation and hunting stand illustrated in FIG. 1, illustrating the frame folded in half into its storage and transport disposition, with the brace assembly mounted on the apparatus for transport thereof.

Operation of the mobile observation and hunting stand apparatus 10 is generally as follows. As illustrated in FIG. 3, the stand apparatus 10 is in its folded storage and transport disposition. The upper frame portion 38 is folded over onto the lower frame portion 39 with the foot support truss members 18 extending upwardly from the frame 12 and with the foot support 16 pivoted against the frame 12. The brace assembly 21 is disassembled, bundled, and placed on the frame 12 between the foot support truss members 18 which act as side braces for the bundled brace assembly 21. Bungee cords (not shown) or the like may be used to secure the bundled brace assembly 21 and to hold the frame 12 in its folded condition. Thus, a hunter can roll the stand apparatus like a wheelbarrow, engaging the seat portion 2*d* of the frame 12 and pushing the stand apparatus 10 to and from a desired hunting area.

Once in the hunting area, the sportsman makes the decision whether to lean the stand apparatus 10 against a tree T or to erect the stand apparatus 10 in a freestanding disposition in a clearing. It the stand apparatus 10 is to be erected against a tree T, the brace assembly 21 is set aside and the frame 12 unfolded into its extended, operative position. Each swaged slip joint 45 affixed to the side rail assemblies 17 of the frame 12 is engaged and cotter pins 48 are fitted into the holes 46. The stand apparatus 10 is then raised to stand upright on its base 36 and leaned against a tree T as illustrated in FIG. 2. When the stand apparatus 10 is raised with the base 36 in ground engagement, it is unnecessary to remove the wheel 30. Due to the wheel 30 being spaced away from the base in a direction toward the midpoint of the frame 12, the wheel 30 is out of ground engagement when the stand apparatus 10 is erected. Therefore, the wheel 30 need not be removed prior to erecting the stand apparatus on its base 36 for use. This feature of the present invention eliminates the necessity of carrying a tool for removing the wheel 30 and saves the hunter time when on a hunting expedition. Once the stand apparatus 10 is erected, the hunter ascends to his outpost on the seat 20 by climbing the rungs 14 attached to the frame 12.

Should the sportsman decide to move to an area lacking a suitable separate support member, he descends the stand apparatus 10 and removes the stand apparatus 10 from the upright position. Once the stand apparatus 10 is away from the tree T and resting on the ground, the cotter pins 48 are removed and the stand apparatus 10 refolded, the brace assembly 21 put back in place for rolling transport and the stand assembly 10 rolled on the wheel 30 to the next hunting site.

With the stand in its new, treeless location, the brace assembly 21 will be assembled to provide a freestanding unit. Once again, the frame 12 is unfolded and cotter pins 48 are inserted into the holes 46 of the swaged slip joint 45. The brace assembly 21 is then assembled and mounted to the frame 12 and the resultant structure is then erected with the base 36 and the two vertically oriented rod assemblies 22 in a tripod-like orientation in ground engagement. Once the cross members 26, 28 are secured in place, the hunter may then ascend the stand apparatus 10 to his outpost on the seat 20.

As can be seen from the above, the mobile observation and hunting stand apparatus 10 of the present invention provides a versatile hunting stand that can be used as a freestanding unit or leaned against a tree. A wheel 30 is permanently mounted to the frame 12 providing rolling movement for transport of the stand apparatus 10. Since the wheel 30 is disposed a distance along the frame 12 away from the base 36, it will be out of ground engagement when the stand apparatus 10 is erected for use. Accordingly, the wheel 30 need not be readily removable from the frame 12 and can be permanently mounted thereto. The permanently mounted wheel 30 alleviates the hunter's need for special wheel removal tools and eliminates the trouble and time of removing and reinstalling the wheel 30 whenever the stand apparatus 10 is used.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A mobile observation and hunting stand apparatus comprising:

an elongate ladder-like frame having laterally-extending rungs spaced lengthwise therealong to enable a user to climb end-to-end along said frame, said frame including a first frame portion and a second frame portion pivotably attached to one another for selective folding and unfolding movement between an operative disposition wherein said first and second frame portions are aligned in an end abutting relation and a storage and transportation disposition wherein said first and second frame portions are disposed in a proximate side-by-side relation;

a base on one end of said frame for ground engagement when said frame is unfolded into its operative disposition for erection in an upright orientation for use;

a seat at the other end of said frame;

at least one wheel permanently affixed to said frame at a location sufficiently adjacent said base for ground engagement of said wheel when said frame is folded in its storage and transportation disposition and oriented in a generally horizontal orientation to facilitate manual rolling movement of said frame by a user gripping said frame at a spacing from said wheel, said wheel being spaced at a sufficient distance from said base to be out of ground engagement upon erection of said frame in an upright orientation in its unfolded operative disposition for use of said frame without removal of said wheel;

a foot platform projecting outwardly from said frame adjacent said seat and being movable between a storage position against said frame and a use position generally perpendicular to said frame for user foot support;

a pair of truss members laterally spaced from one another at opposite sides of said frame adjacent said foot platform for supporting said foot platform when in its use position generally perpendicular to said frame and to form side supports for retaining articles carried on said frame during rolling movement thereof; and brace means selectively mountable removably to said frame for selective free-standing support of said frame in an upright orientation without placement thereof against a tree, pole or other fixed separate structure when said brace means is mounted to said frame in its unfolded operative disposition, said brace means comprising a pair of elongate braces, each attachable at one respective end thereof to said frame adjacent said seat in an orientation wherein the opposite respective ends of said brace are disposed for ground engagement at lateral spacings from one another and from said base to cooperatively form therewith a tripod-like support for said seat, said frame being alternatively supportable in an upright orientation in its unfolded operative disposition for use when said brace means is demounted from said frame by placement with said base in ground engagement and said other end of said frame leaning against a tree, pole or other like fixed structure.

2. A mobile observation and hunting stand according to claim 1 wherein said frame includes means for selectively locking said frame portions against relative movement when in said operative disposition.

3. A mobile observation and hunting stand according to claim 1 wherein said brace means includes a plurality of struts detachably mountable to extend laterally between said braces and said frame when said brace means is mounted to said frame to rigidify and stabilize said brace means and said frame relative to one another.

* * * * *